US005440462A

United States Patent [19]

Kim et al.

[11] Patent Number: 5,440,462

[45] Date of Patent: Aug. 8, 1995

[54] HEAD-MOUNTED LIGHTING ASSEMBLY

[75] Inventors: Richard Kim; Eric J. Sieczka, both of Ann Arbor, Mich.; David Nowak, Dexter, Mich.

[73] Assignee: General Scientific Corporation, Ann Arbor, Mich.

[21] Appl. No.: 223,540

[22] Filed: Apr. 6, 1994

[51] Int. Cl.[6] ..... F21L 15/14

[52] U.S. Cl. ..... 362/105; 362/268; 362/293; 362/396

[58] Field of Search ..... 362/105, 106, 255, 256, 362/268, 293

[56] References Cited

U.S. PATENT DOCUMENTS

| | | | |
|---|---|---|---|
| 4,210,952 | 7/1980 | Resstneyer | 362/17 |
| 4,406,040 | 9/1983 | Cannone | 362/106 |
| 4,554,621 | 11/1985 | Corrigan | 362/382 |
| 4,633,377 | 12/1986 | Mackiewicz | 362/309 |
| 5,144,540 | 9/1992 | Hayes | 362/268 |
| 5,274,535 | 12/1993 | Gonser | 362/268 |

FOREIGN PATENT DOCUMENTS

| | | | |
|---|---|---|---|
| 309640 | 4/1929 | United Kingdom | 362/293 |

*Primary Examiner*—Carroll B. Dority
*Attorney, Agent, or Firm*—Gifford, Krass, Groh, Sprinkle, Patmore, Anderson & Citkowski

[57] ABSTRACT

A compact, lightweight illumination system for producing a uniform, intense, and adjustable light beam. The illumination assembly may be easily mounted upon the head of a user, either on a headband or a spectacle frame. The illumination system includes a unique optical subassembly consisting of a low pass heat filter, a low scatter angle diffuser, and a compound projection/-focussing lens sandwiched together and disposed along an optical axis. The optical subassembly may be used in conjunction with a conventional filament lamp illumination source to produce a readily adjustable, yet uniform and intense, beam of light.

10 Claims, 2 Drawing Sheets

HEAD-MOUNTED LIGHTING ASSEMBLY

FIELD OF THE INVENTION

The present invention relates to an illumination assembly for mounting upon the head of a user, and, more particularly, to such an illumination assembly that provides a lightweight source of localized, intense illumination of adjustable area.

BACKGROUND OF THE INVENTION

Head-mounted illumination systems are often used by dentists, surgeons, ophthalmologists, etc. when performing examinations and medical procedures since such systems leave the hands free and also project illumination in the same direction the user is looking. Most head-mounted illumination systems use standard flashlight technology (a filament-based lamp with a back reflector). Such illumination systems cannot provide very uniform illumination. Even those systems which use very expensive and precision reflectors have difficulty producing a clean and uniform beam of light. The uniform illumination is not maintained over the long focal range, and these systems produce much stray light.

An ordinary imaging illuminator, using a standard bulb and an imaging lens, has a low collection efficiency and produces a dim light beam. The magnified image of the bulb filament in the illumination plane produces a very uneven light structure.

A uniform, intense illumination area can be produced by using fiber optic illuminators, wherein a very high intensity light source is used with an optical fiber bundle. However, the user must be constantly attached via a tether to the heavy fiber bundle which is, in turn, anchored to an illuminator box that must be plugged into a power outlet. Thus, the mobility and comfort of the wearer is significantly reduced.

What is needed is a compact, portable, lightweight illumination system which may be mounted on the head of a user via a headband, spectacle frames, etc. and which produces intense illumination of a uniform pattern. What is also needed is such an illumination source wherein the spot size of the illumination can quickly and easily be adjusted by the user while maintaining the uniformity of the illumination.

SUMMARY OF THE INVENTION

The present invention has been designed to overcome the problems in the prior art noted above. It provides uniform and bright illumination in a small, lightweight and compact package (including the entire light source, optics and all mechanical components) that can be directly mounted on a headband or a spectacle frame vision system. The intense, uniform light beam produced by the present invention may be localized onto the operative area (i.e., the mouth cavity) so as to eliminate stray light which can irritate or blind the patient.

The invention is a lightweight light assembly for mounting on the head of a user. The light assembly includes a filament lamp preferably having a collecting lens formed integrally therewith. The filament lamp and integral collecting lens are disposed along an optical axis. A lens subassembly is also disposed along the optical axis. The assembly includes (in sequential order in a direction away from the filament lamp): a low pass (heat) filter; a low scatter angle diffuser; and a projection/focussing lens. The low pass filter is an optional element which is used to increase the apparent color temperature of the illumination, as well as to block heat from escaping through the front of the lens. The projection/focussing lens, which is preferably a single-element lens having an aspheric convex front face and a planar rear face, produces a uniform beam by focussing the light diffused from the low scatter angle diffuser. Furthermore, the uniform beam projected from the projection/focussing lens maintains its uniform characteristic even when the spot size of the illumination is decreased or increased. This optical subassembly produces very uniform light distribution at the image plane without the uneven structure usually associated with filament based lamp projection.

The optical subassembly is held together by a holder which retains the components thereof in aligned relationship along the optical axis. Preferably, the holder is threaded. The light assembly of the present invention further includes a lamp housing having a cylindrical chamber formed therein inside which is mounted the filament lamp and integral collecting lens. The lamp housing is threaded for mating and rotating engagement with the lens subassembly holder. Thus, the distance between the lamp assembly and integral collection lens and the optical subassembly may be either decreased or increased by simply rotating the holder clockwise or counter-clockwise as desired. Increasing the distance between the filament lamp and the optical subassembly will cause the spot size of the illumination to decrease, whereas decreasing the distance will cause the spot size to increase. In a preferred embodiment, the lamp housing threads are formed on the cylindrical chamber.

Preferably, the lamp housing is pivotally mounted to a clamp so that the entire light assembly may be clamped to a headband or spectacle frame worn by the user. Preferably, the relative positions of the lamp housing with respect to the clamp (and thus the eyes of the user) may be fixed so that the user may maintain the optical axis of the light assembly in a desired angular relationship with respect to the user's face. Thus, the light assembly of the present invention may be adjusted to the correct angular relationship with the user's face, and this position fixed: the spot size of the uniform light beam produced by the light assembly may also be adjusted, thus providing an illumination assembly which is adaptable to a wide variety of illumination requirements.

In another preferred embodiment, the lamp housing of the light assembly further comprises a hollow, cylindrical lamp guide through which the filament lamp bulb and collection lens integral therewith project. The base end of the filament lamp bulb is mounted in a lamp socket which carries a pair of electrical leads. A back cover is permanently mounted to the lamp socket and removably mounted to the lamp housing (such as by screws) so that the filament lamp is removably mounted in the lamp housing for replacement as necessary.

BRIEF DESCRIPTION OF THE DRAWINGS

The following detailed description is best understood by reference to the following drawings in which.

DETAILED DESCRIPTION OF THE PREFERRED EMBODIMENTS

Figure 1:
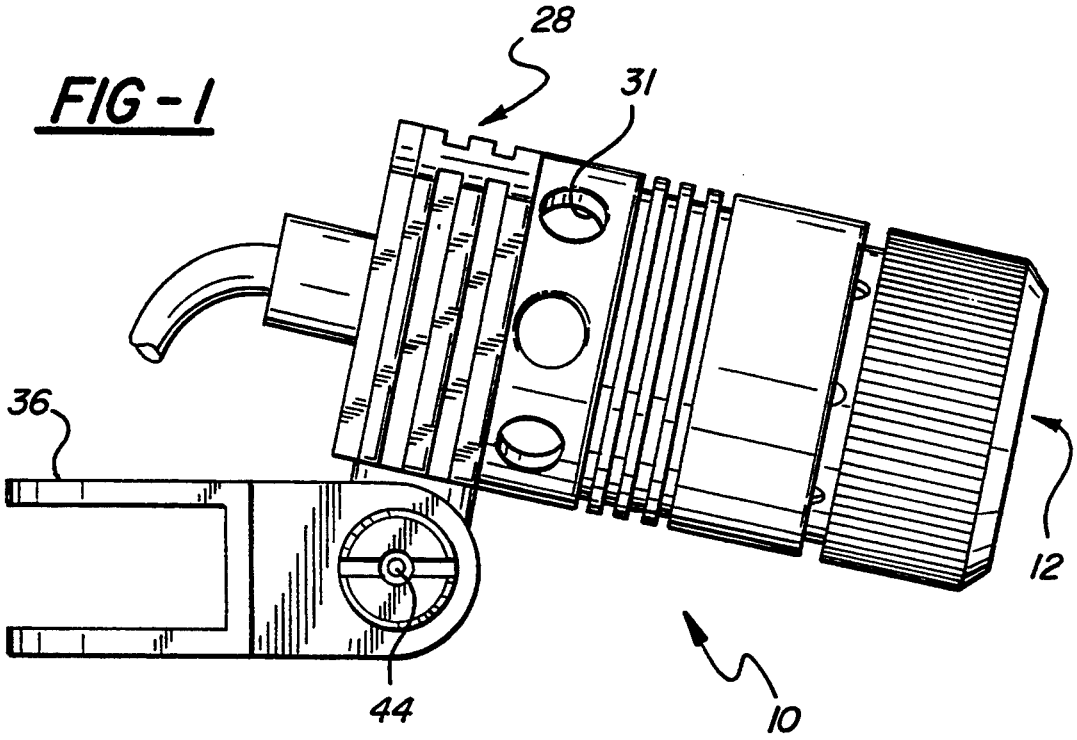
FIG. 1 is a side view of a light assembly constructed according to the present invention.
Figure 3:
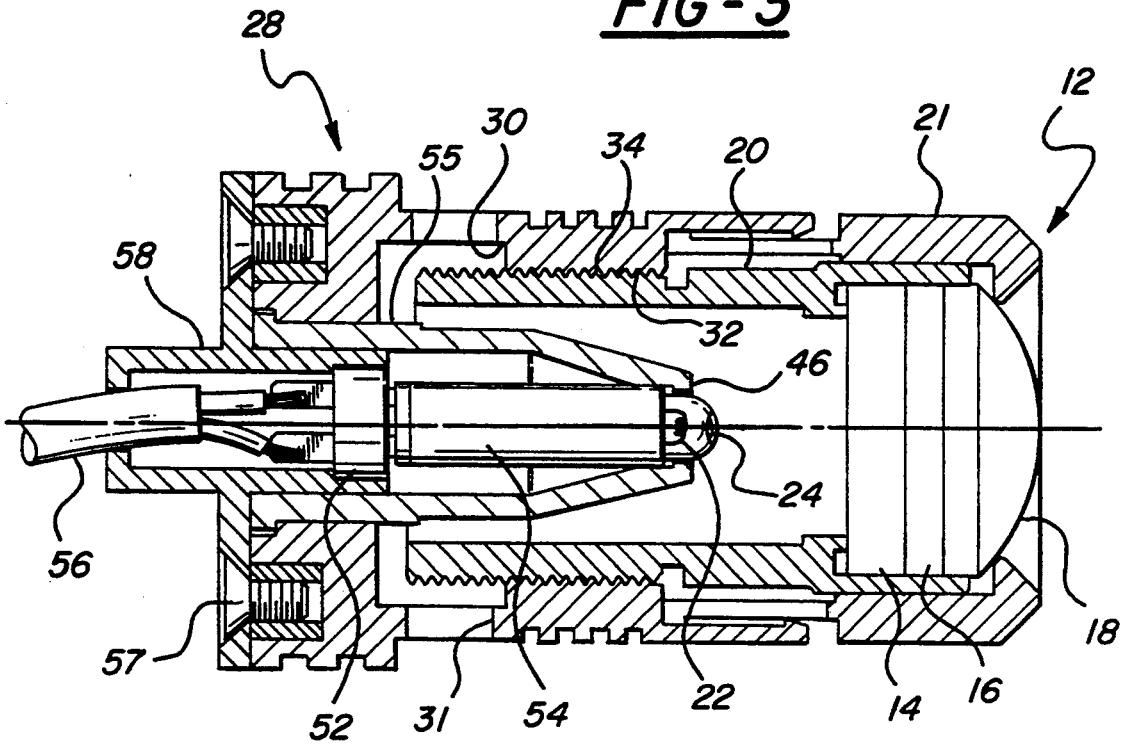
FIG. 3 is a detail view of the lamp housing and optical subassembly of the light assembly of the present invention with certain elements thereof shown in cross section.

Throughout the following detailed description, like numerals are used to reference the same element of the herein invention shown in multiple figures thereof. Referring now to the drawings, and in particular to FIGS. 1 and 3, there is shown a side view (with certain structure shown in cross section) of a lightweight compact light assembly 10 capable of producing a localized intense light beam of adjustable diameter. The lightweight light assembly 10 includes a novel optical subassembly 12 which, as can best be seen in the detail view of FIG. 3, is formed of a sandwich of three optical components: the first is a low pass heat filter 14. Although this element is optional, it does increase the apparent color temperature of the illumination as well as block heat from escaping through the front of the lens. In front of the low pass filter 14 is a low scatter angle diffuser 16. In front of the diffuser 16 is a projection/focussing lens 18 which is shown as a lens having an aspheric convex front surface and a flat rear surface. Optical elements 14–18 are disposed along optical axis A and are retained in position along that axis by means of an assembly including lens holder 20 and retainer 21.

Also disposed along optical axis A is a conventional filament lamp 22 having an integral lens 24 for collecting the light emanating from the filament lamp 22. Thus, light which emanates from the filament lamp 22 passes through collection lens 24, and thence through the optical subassembly 12 (that is, it is sequentially filtered by the heat filter 14, diffused by the low scatter angle diffuser 16, and finally focussed by the projection/focussing lens 18).

Figure 4:
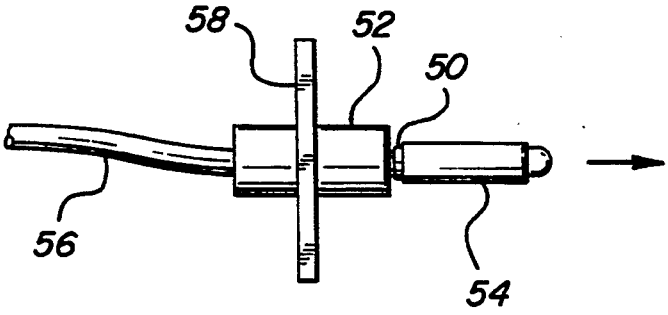
FIG. 4 is a detail view showing the arrangement of the filament lamp bulb, lamp socket and back cover.

Lamp filament 22 and lens 24 which it carries are disposed inside of a cylindrical chamber 30 formed in a lamp housing 28. The main body 54 of the lamp filament 22 is guided by a cylindrical lamp guide 55 which is pressed into the main lamp housing 28. Cylindrical lamp guide 55 has an aperture 46 through which collecting lens 24 projects. The main lamp body 54 includes a base 50 which is inserted into a conventional lamp socket 52. The lamp socket 52 is soldered to two-wire pigtail lead 56, and then permanently mounted to back cover 58 to form a socket/cover subassembly. As can most clearly be seen in FIG. 4, the main body 54 of the lamp filament 22 is inserted into the socket 52, and then the whole assembly is inserted into the main lamp housing 28. The main lamp body 54 may be easily removed from the socket 52 by pulling in the direction indicated by the arrow. The back cover 58 is, preferably, fastened by using two screws 57. The main lamp housing preferably includes many vent holes 31 for dissipating heat from the chamber 30.

The lightweight light assembly 10 of the present invention includes a provision for adjusting the spot size of a beam produced therefrom. The lens holder 20 is, preferably, formed with threads 32. Mating threads 34 are formed in the chamber 30 of the lamp housing 28. Thus, the lens subassembly 12 may be threaded in and out from the lamp housing 28 to provide spot size adjustments. Tabs in both the lens retainer 21 and the lamp housing 28 provide a positive stop mechanism such that the lens subassembly 12 cannot fall out accidentally while it is being unscrewed for focussing purposes.

Figure 2:
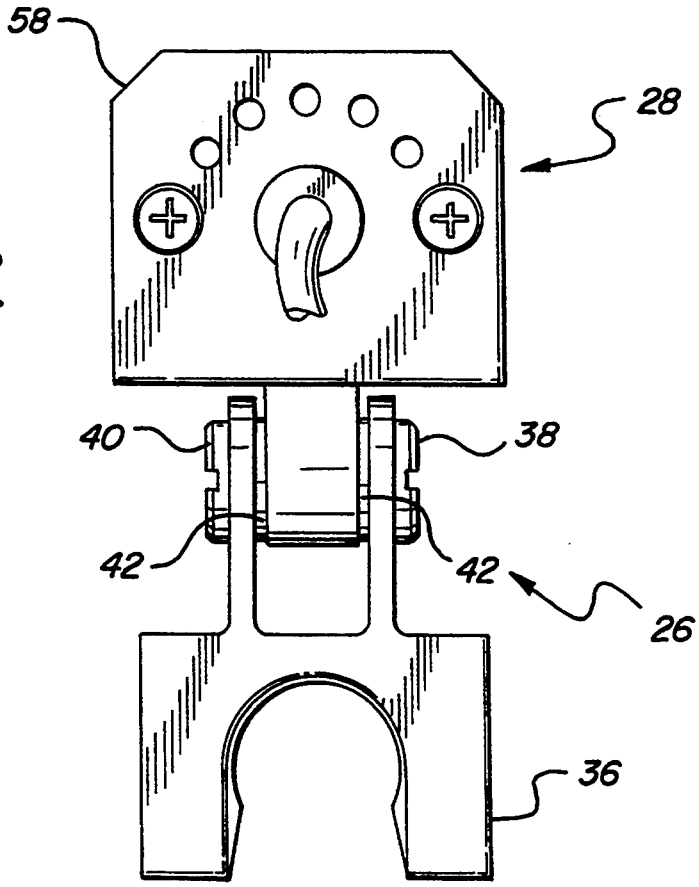
FIG. 2 is a rear view of the light assembly of FIG. 1.

As can most clearly be seen in FIGS. 1 and 2, the lamp housing 28 is attached to a mounting clamp 36 by a special linkage assembly 26. The linkage assembly 26 includes screw 38, nut 40, a pair of Belleville washers 42, and set screw 44. The linkage assembly 26 provides variable frictional rotation of the lamp housing 28 (to allow vertical movement of the beam) without twisting. The mounting clamp 36 clips onto a headband or frame mounted device to provide easily attachable, coaxial illumination which can be easily adjusted for both spot size and direction.

What has been disclosed is a compact, lightweight, head-mountable source of illumination which provides a localized, intense, uniform and adjustable light beam. Although the present invention has been depicted with regard to certain embodiments and exemplifications thereof, variation in the disclosed designs may occur to one of skill in the art having the benefit of the teachings of the present invention. Furthermore, while the depicted embodiment shows the optical subassembly of the present invention used in conjunction with a conventional filament-type lamp, it is possible that the optical subassembly may be used with other light sources and in other applications where a uniform, intense, and adjustable source of illumination is required. However, such design variations are considered to be within the scope of the present invention. Thus, the true scope of the present invention is not limited to the particular embodiments and exemplifications depicted, but rather, solely by the claims appended hereto and all reasonable equivalents thereof.

We claim:

1. An optical assembly for providing a lightweight source of localized, intense illumination from a filament lamp having a collection lens integral therewith, said assembly comprising:

a lens subassembly disposed along an optical axis and including:

a low scatter angle diffuser for diffusing light transmitted by a light source disposed along said optical axis;

a projection/focussing lens for projecting and focussing said diffused light into a uniform light beam of adjustable illumination areas; and means for retaining said subassembly in aligned relationship along said optical axis.

2. The assembly of claim 1 wherein the lens subassembly further comprises a low pass filter disposed along said optical axis between said diffuser and said collections lens.

3. The assembly of claim 1 wherein the projection/focussing lens is a lens having an aspheric front convex surface and a planar rear surface.

4. A lightweight light assembly for mounting on the head of a user comprising:

a filament lamp and collecting lens integral therewith disposed along an optical axis;

a lens subassembly disposed along said optical axis and including:

a low scatter angle diffuser for diffusing light transmitted by said filament lamp and integral lens; and a projection/focussing lens for projecting and focussing said diffused light into a uniform light beam of adjustable illumination area;

a holder for retaining said lens assembly in aligned relationship along said optical axis; and means for mounting said light assembly on the head of a user.

5. The light assembly of claim 4 further comprising a lamp housing having a cylindrical chamber formed therein for containing said filament lamp and collecting lens integral therewith, threads formed on said optical subassembly holder, and mating threads formed on said lamp housing for rotating engagement with said threads formed in said holder such that the illumination area of said uniform light beam may be adjusted by rotating said holder with respect to said lamp housing to increase and decrease the distance between said optical subassembly and said collecting lens.

6. The light assembly of claim 5 wherein the lamp housing threads are formed on said cylindrical chamber.

7. The light assembly of claim 5 wherein the means for mounting said light assembly on the head of a user includes a mounting clamp pivotally mounted to said lamp housing, and means for fixing the relative positions of said clamp and said light assembly.

8. The light assembly of claim 5 further comprising a mounting clamp pivotally mounted to the lamp housing by a linkage assembly including a screw extending through said clamp and said lamp housing, a nut threaded onto an end of said screw, a pair of Belleville washers disposed between said clamp and said lamp housing, and a set screw disposed in engagement with said nut so as to provide variable frictional rotation of the housing with respect to the clamp.

9. The light assembly of claim 7 wherein said clamp is mountable on a headband or spectacle frame worn by the user.

10. The light assembly of claim 5 wherein the lamp housing further includes a cylindrical, hollow lamp guide disposed in said chamber, said filament lamp having a free end carrying said integral collecting lens which projects through said lamp guide;

a lamp socket mounted to the other end of said filament lamp;

a pair of electrical leads attached to said lamp socket; and a back cover mounted to said lamp socket and removably mounted to said lamp housing such that said filament lamp and lens integral therewith are removably mountable in said lamp housing.

* * * * *